US005313914A

United States Patent [19]

Woollen

[11] Patent Number: 5,313,914

[45] Date of Patent: May 24, 1994

[54] POTABLE HOT WATER STORAGE VESSEL AND DIRECT-FIRED HEAT EXCHANGER

[76] Inventor: Donald E. Woollen, 11610 104th La., North, Largo, Fla. 34643

[21] Appl. No.: 980,636

[22] Filed: Nov. 24, 1992

Related U.S. Application Data

[63] Continuation-in-part of Ser. No. 785,004, Oct. 30, 1991, Pat. No. 5,207,212.

[51] Int. Cl.[5] ..... F24H 1/00

[52] U.S. Cl. ..... 122/136 R; 122/13.1; 122/367.2; 126/360 A

[58] Field of Search ..... 122/136 R, 13.1, 367.1, 122/367.2, 235.12; 126/360 A, 360 R

[56] References Cited

U.S. PATENT DOCUMENTS

| | | | |
|---|---|---|---|
| 1,394,897 | 10/1921 | Haus | 122/13.1 |
| 2,594,234 | 4/1952 | Swindin | 126/360 A |
| 3,266,485 | 8/1966 | Girton | 126/360 R |
| 3,349,754 | 10/1967 | Bock | 126/360 R |
| 3,734,066 | 5/1973 | Scheyen | 122/367 R |
| 4,637,347 | 1/1987 | Troy | 122/20 A |
| 4,865,014 | 9/1989 | Nelson | 126/361 |
| 4,981,112 | 1/1991 | Adams et al. | 122/19 |
| 5,179,914 | 1/1993 | Moore et al. | 122/17 |

*Primary Examiner*—Henry A. Bennet
*Assistant Examiner*—William C. Doerrler
*Attorney, Agent, or Firm*—Herbert W. Larson

[57] ABSTRACT

The inner surface of a hot water storage vessel is lined with a removable rigid plastic liner layer with injected foam insulation located between the liner and storage vessel. A heat exchanger is mounted through an integral first flange to a second flange integral with the liner. In turn, the second flange is mounted to a third flange integral with the storage vessel. Fittings on the first flange permit entry into the water containing chamber for inlet and outlet piping as well as for thermostats and pressure relief valves. No piping passes through the liner or storage vessel.

12 Claims, 4 Drawing Sheets

POTABLE HOT WATER STORAGE VESSEL AND DIRECT-FIRED HEAT EXCHANGER

CROSS-REFERENCE TO RELATED APPLICATIONS

This application is a continuation in part of the pending application of Donald E. Woollen Jr., Ser. No. 07/785,004 filed Oct. 30, 1991, entitled "SUBMERSIBLE HIGH-EFFICIENCY COMBUSTION CHAMBER FOR A WATER HEATER" now U.S. Pat. No. 5,207,212 issued May 4, 1993.

BACKGROUND OF THE INVENTION

1. Field of The Invention

This invention relates to water storage vessels used for potable water supplies. More particularly, it refers to such vessels used as water heaters with direct-fired combustion chambers.

In known water heaters and storage vessels such as described in U.S. Pat. No. 3,207,358, the vessel itself, typically a steel tank, is coated with a corrosion resistant material. This material, designed to protect the tank from the corrosive effects of water is generally applied directly to the tank surface. This may be done through the application of a spray-on plastic type material, electrochemically plating the material, a slush type molding process or more recently, electroless nickel coatings. In each of these processes, the coating material is integrally bonded to the vessel interior. While these coatings do provide a reasonable degree of protection to the vessel interior, their drawbacks are numerous.

In most cases, preparation of the tank itself is critical for proper adhesion of the coating. This generally requires sandblasting or chemical etching of the vessel to be coated. This in itself can be a costly and time consuming process and if not done correctly can result in lining breakdown and tank failure. The majority of lining materials are expensive and vessels often require multiple coats to insure proper coverage, another costly and time consuming process. In those instances where proper coverage is not obtained, the tiniest pinhole or air bubble can result in tank failure.

Because lining failures are internal, when they do occur, the vessel wall is already damaged prior to any external evidence of a problem. Typically, it is not until the water in the vessel causes the exposed metal surface to rust and an external leak develops that the damage is discovered. Repair of this type of failure, if possible at all, is generally expensive and time consuming and often satisfactory results can not be achieved.

Even granting that proper coverage is obtained all lining materials and particularly those in higher temperature applications (160 degrees F) breakdown over time. This makes very desirable the development of an easily replaceable liner. One attempt to do this is found in Adams et al. U.S. Pat. No. 4,981,112. In this design a flexible, non-molded liner is installed within the vessel interior. This design also provides a replaceable liner which facilitates proper operation so that it is not necessary to discard the vessel body in the case of a damaged or defective liner. Several disadvantages of this design are as follows:

(1) The liner is formed by joining one or more seams or weld lines causing the possibility of a flaw in the seam or weld line. In addition, the fabrication of a multiple piece liner requires considerable time and labor.

(2) The lip portion of the liner must be fused or vulcanized to the remainder of the liner. This process is susceptible to the same criticism as in (1) above and again, requires additional labor.

(3) Specially constructed flanges which seal the lining against the tank are required for all openings into the vessel, i.e., hot water outlets, cold water inlet, thermostats, etc. To accommodate these flanges, the tank must be fitted with bolts which are stud welded to the tank.

(4) In some instances, it may be necessary to pull a slight vacuum between the liner and the open interior of the vessel during the liner installation which would increase manufacturing and replacement time and cost.

An improved liner is needed for direct-fired heat exchangers and hot water storage systems.

SUMMARY OF THE INVENTION

The present invention provides a direct-fired heat exchanger and hot water storage system with an improved liner resistant to water corrosion and a prolonged working life even at elevated temperatures (200 degrees F+). The liner is preferably a rigid, one piece molded design, can be easily and inexpensively manufactured and is easily installed and replaced.

In addition, a monitoring system detects lining failure before any water damage to the tank can occur. No openings through the tank or liner are necessary for the attachment of hot or cold water lines, thermostats, relief valves, etc.

The heat exchanger and water storage combination of the invention includes a vessel body having one closed end and one open end communicating the vessel interior to an exterior portion. A rigid, one piece, molded liner is installed within the vessel body through the open end. A heat exchanger with a mounted flange is mated to tank and liner openings. The flange contains all inlets and outlets necessary for proper operation including, but not limited to, cold water inlet, hot water outlet, thermostats, and temperature/pressure relief valves.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
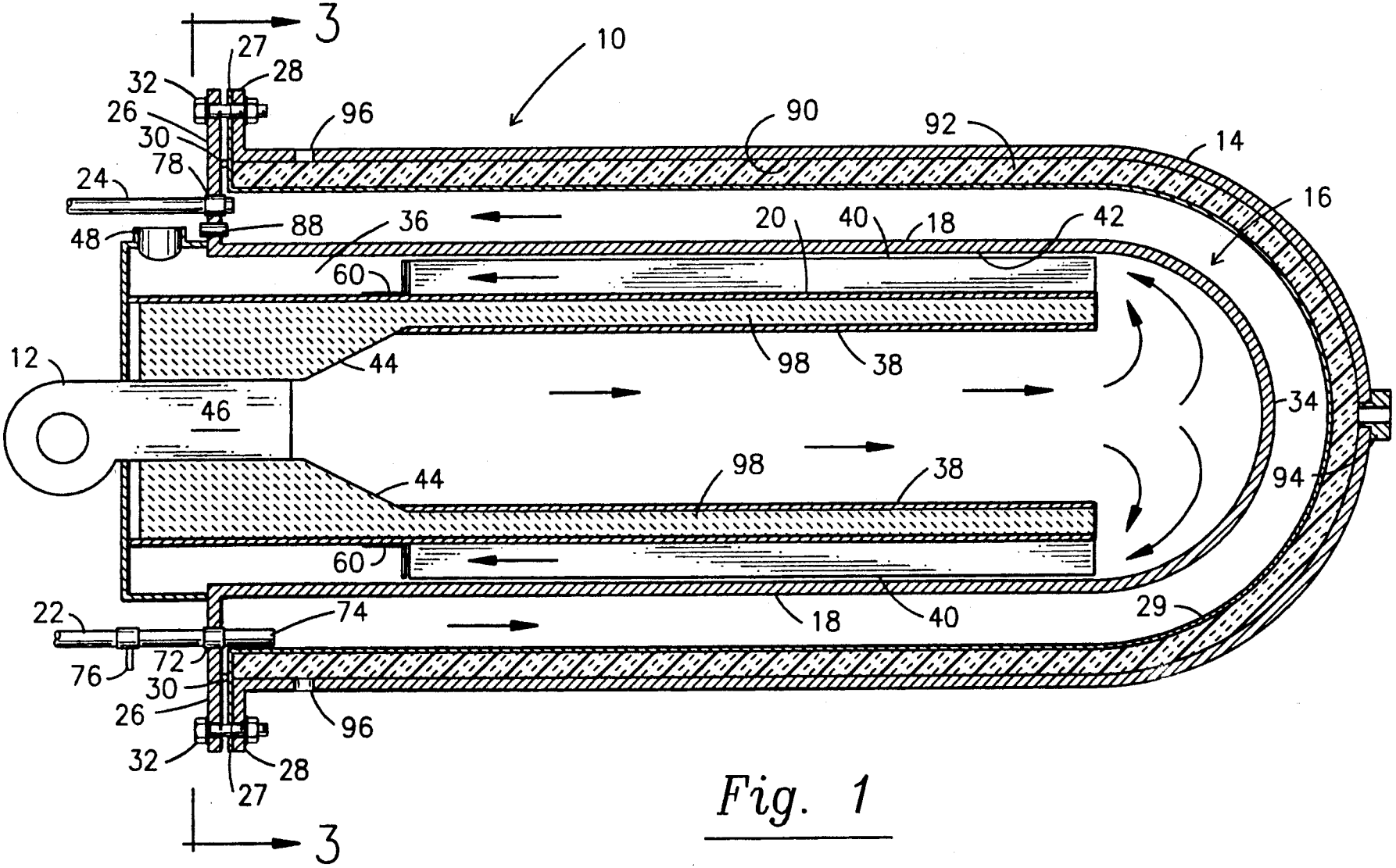
FIG. 1 is a simplified, side view, partially in cross section, showing an assembled, potable hot water storage vessel and heat exchanger combination, having the replaceable liner installed within the vessel body.

Throughout the following detailed description, the same reference numerals refer to the same elements in all figures.

A water heater 10 including a burner 12, a water storage vessel 14 and a heat exchanger 16, also referred to as a combustion chamber is shown in FIG. 1. The major components of the heat exchanger 16 are an outer shell 18 and inner shell 20. Water is introduced into the tank 14 through an inlet 22 and withdrawn from the tank through an outlet 24.

In accordance with the invention, water in the vessel 14 is heated by a heating unit indicated generally by 12 which is mounted to the heat exchanger 16 or combustion chamber. The heat exchanger 16 is comprised of an outer shell 18 having a generally cylindrical shape which is inserted directly into the tank 14 and forms the component of the heating unit that directly contacts the water to be heated. The front end of the outer shell 18 has a mounting flange 26 that mates with a corresponding flange 27 of the tank liner 29 which in turn mates with flange 28 in the sidewall of the tank 14. An O-ring or gasket 30 is inserted between the two flanges 26 and 27 to form a seal therebetween. Bolts 32 are inserted through the mounting flanges 26, 27 and 28 to secure the outer shell 18 to the vessel 14.

The front end of the outer shell 18 on which the mounting flange 26 is disposed is unsealed to allow the inner shell 20 to be inserted within the outer shell 18. The back end 34 of the outer shell 18 remote from the mounting flange 26 is sealed. This closed end serves as the primary surface through which heat is exchanged between the heating unit 12 and the water.

In one embodiment of the invention, the closed end 34 of the outer shell 18 is planar. In an alternative embodiment of the invention as seen in FIG. 1, the closed end 34 of the outer shell 18 is dome-shaped with the closed end curving outward. An outer shell 18 having a dome-shaped closed end is particularly advantageous when the heating unit is to be installed in a large capacity storage vessel 14 since it will better withstand the increased static pressure exerted on the exterior surfaces of outer shell 18 than would a planar-shaped closed end. To prevent the outer shell 18 from being corroded by the water in the tank 14, the exterior surfaces of the outer shell 18 can be clad in any suitable coating such as a thin sheet of copper. Alternatively, it can be coated with Ceramite "Glassguard". "Glassguard" is a trademark of England Hughes Bell & Co. Ltd. of Manchester, England.

As seen in FIG. 1, the hollow cylindrical inner shell 20 which serves as a combustion chamber is inserted into the outer shell 18 to form an annular clearance space 36 therebetween. The inner shell 20 serves as the input end for the exhaust gases emitted by the burner 12. After traversing the interior of the inner shell 20, the exhaust gases are expelled from the back or exhaust end of the inner shell 20. The inner surface 38 of the inner shell 20 is a layer of stainless steel backed by a refractory material that has a thickness sufficient to prevent the outside surface of the shell 20 wall from being exposed directly to the heat, which could result in metal fatigue.

As FIGS. 2 through 5 illustrate, fins 40 are disposed circumferentially about the exterior surface of the inner shell 20. The fins 40 each have a height extending in the radial direction with respect to the longitudinal axis of the inner shell 20 and they each have a length extending in the longitudinal direction. The fins 40 support the inner shell 20 within the outer shell 18.

Figure 2:
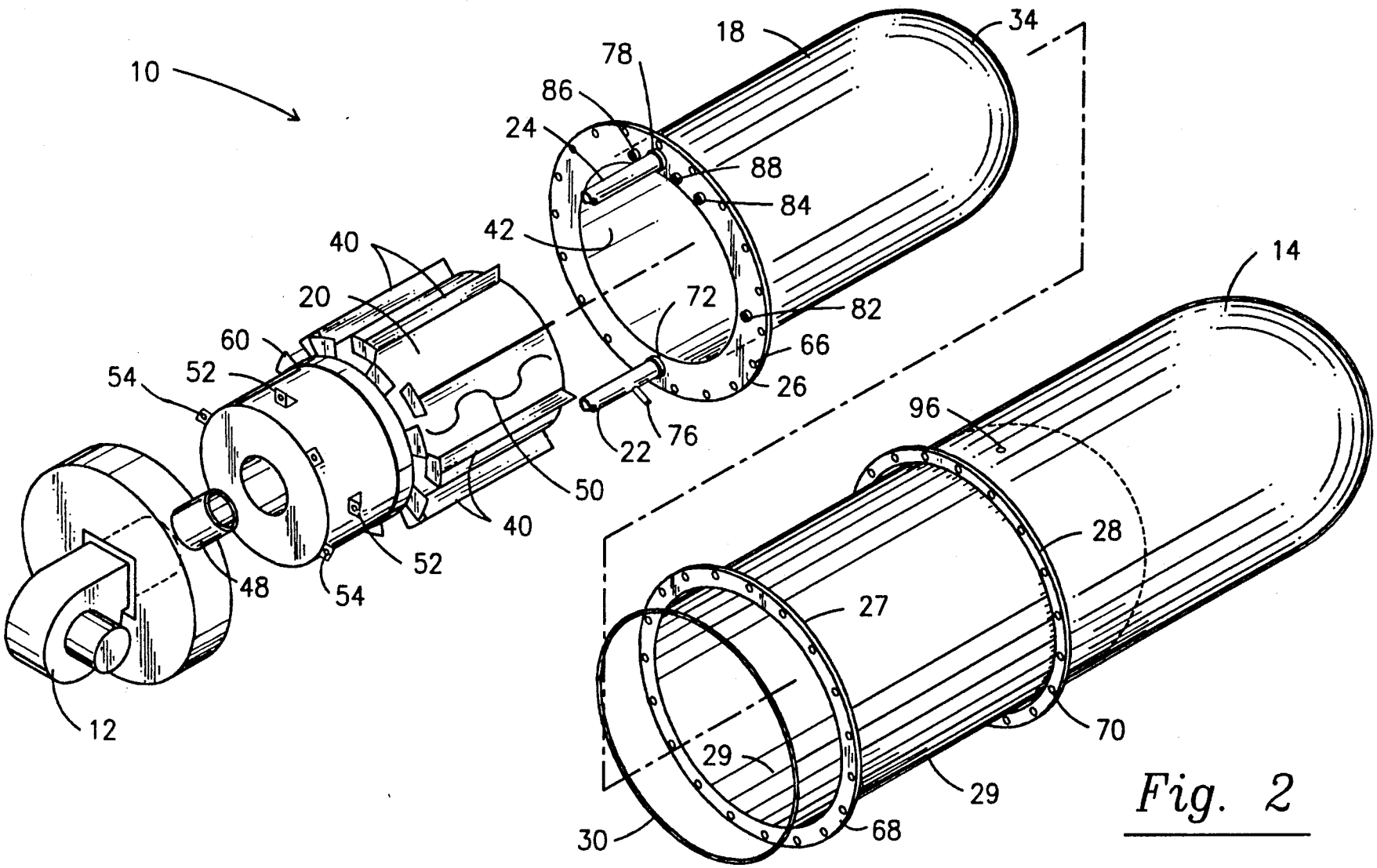
FIG. 2 is a perspective view of the exterior shell of the heat exchanger and the component interfitting parts showing the flanges with piping outlets.

Flue baffles 50 as shown in FIG. 2 are also positioned circumferentially about the exterior surface of the inner shell 20 and extend between adjacent pairs of fins 40. The baffles 50 do not contact the fins 40 but are spaced apart to form a passageway through which exhaust gases may be conducted as seen in FIG. 1. The height of the baffles 50 in the radial direction is less than the height of the fins 40 and thus the baffles do not contact the outer shell 18. The baffles 50 are not necessarily fixed to the inner shell 20, but may be advantageously designed to slide in and out of the annular clearance space 36 so that they may be replaced without removing either the inner shell 20 or the outer shell 18. The clearance space between the baffles 50 and the fins 40 as well as the clearance between the baffles 50 and the interior wall 42 of the outer shell 18, form an axially extending passageway 36 along which the exhaust gas is conducted after the gas has exited the exhaust end of the inner shell 20 and has been deflected by the closed back end 34 of the outer shell 18. In FIG. 1, the arrows within the outer shell 18 indicate the direction of motion of the exhaust gases along the passageway 36.

Figure 5:
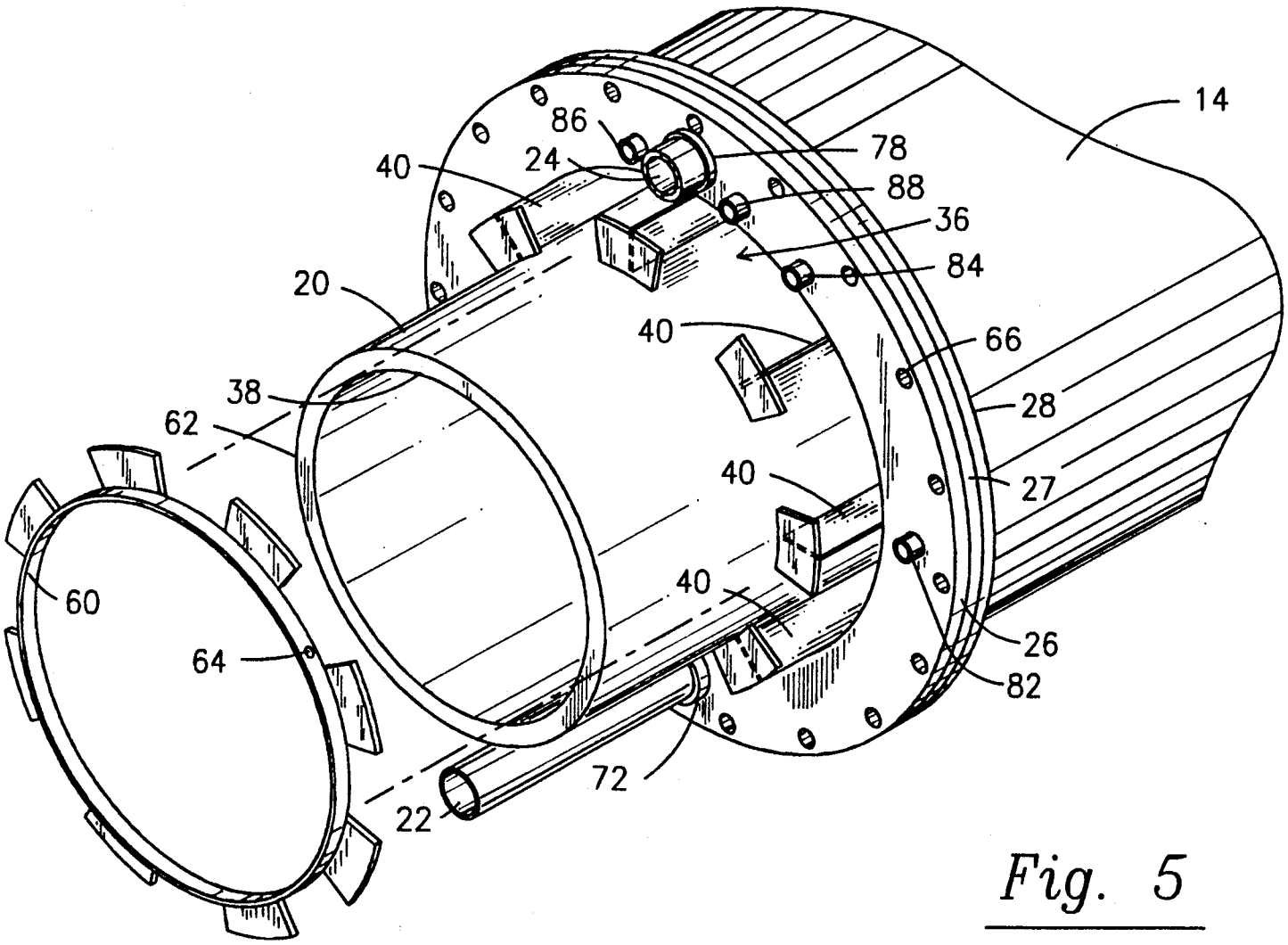
FIG. 5 is an exploded view of the flue gas back pressure ring and its position on the inner shell.

The baffles 50 increase the turbulence of the exhaust gases flowing along the passageway of the clearance space 36, thereby increasing the rate of heat transfer between the outer shell 18 and the water. In FIG. 2, the baffles 50 are shown as having a sinusoidal configuration. However, the baffles 50 more generally can have any shape that increases the turbulence of the gases, including a configuration similar to a sawtooth wave. Furthermore, the baffles 50 may be eliminated in those cases where the heat transfer efficiency is not of primary concern. Similarly, the fins 40 do not necessarily have to be linear or extend in the longitudinal direction, as illustrated in FIGS. 2 and 5, but may have any configuration that cooperates with the baffles 50 to create a turbulent path for the gases. The precise number, length, and position of the baffles 50 which yield the highest efficiency depends on the BTU input of the burner 12.

A spool-shaped sealing element 44 seen in FIG. 1 formed from a refractory material such as a ceramic is inserted into the input end of the inner shell 20. The sealing element 44 has two parallel flanges coupled by a cylindrical tube 46 through which the exhaust gases from the burner are conveyed to the inner shell 20. The blast tube of the burner 12 is inserted into the tube of the sealing element 44. The sealing element 44 prevents the combustion gases from backflowing out of the inner shell 20 into the burner 12.

A back pressure ring assembly 60 as shown in FIG. 5 is fitted over an exterior surface of the front end 62 of the inner shell 20. A set screw 64 holds the back pressure ring assembly 60 on the inner shell 20. The set screw 64 can be loosened so that the back pressure ring assembly 60 can be rotated to increase or decrease back pressure in the combustion chamber.

The back pressure ring assembly 60 in FIG. 5 is used to variably increase or decrease the chamber pressure against which the burner 12 must fire. As the ring is rotated from in front of the plates positioned perpendicularly to the fins 40, the space between the fins from which the flue gases can exit is decreased. When this occurs, the pressure within the chamber created by the firing burner is increased as the flue gases back up in the chamber. This increased pressure causes the burner flame to become shorter and "harder" creating a hotter burning flame. This type flame promotes better heat transfer and results in increased efficiency for the unit.

The burner 12 can comprise any burner having a forced-air design with a power rating appropriate for the size of the heating unit. The burner 12 ignites the mixture of air and fuel (e.g., oil, liquid propane gas, or natural gas). A blower in the burner 12 delivers the gases resulting from the combustion of the air and fuel mixture to the interior chamber of the inner shell 20 via the sealing element 44. The combustion gases are forced through the inner shell 2 and discharged from its exhaust end remote from the burner 12. The exhaust gases are then deflected by the closed end 34 of the outer shell 18. As the hot gas impinges on the back end 34 of the outer shell 18, heat is transferred through the outer shell 18 to the water within vessel 14. After being deflected, the exhaust gases are forced into the clearance space 36 between the outer shell 18 and the inner shell 20 where they are conducted along the axially extending passageway 36 between the fins 40 and the baffles 50. If the closed end 34 of the outer shell 18 is dome-shaped rather than planar, the exhaust gases will be more smoothly directed into the clearance space. While the gases traverse the passageway, additional heat is transferred between the exhaust gases and the water. As the exhaust gases exit the passageway 36 at the output end of the inner shell 20 they are collected by a flue collector 48 and expelled to the atmosphere through an appropriate venting system.

As shown in FIG. 2, brackets 52 are circumferentially disposed on the exterior surface of the sealing element 44 at the input end of the inner shell 20 to assist in mounting the inner shell 20 to the outer shell 18. When the inner shell 20 is properly positioned within the outer shell 18, the inner shell 20 extends axially beyond the mounting flange 26 of the outer shell 18. The fins 40 and the baffles 50 do not extend in the longitudinal direction the full length of the inner shell 20. Rather, the fins 40 and baffles 50 have a length that is no greater than the length of the outer shell 18. Furthermore, the fins 40 and the baffles 50 are positioned on the inner shell 20 in such a way that they are fully contained within the outer shell 18 when the inner shell 20 is properly position within the outer shell 18.

The flue collector 48 encloses the enclosed portion of the inner shell 20 that is not contained within the outer shell 18 and forms a seal with the mounting flange 26. The flue collector 48 is secured to the inner shell 20 by brackets 54 that are circumferentially disposed on the outer surface of the inner shell 20. The brackets 54 are located closer to the input end of the inner shell 20 than are the brackets 52.

The flange 26 of outer shell 18 contains an annular grouping of holes 66 that mate with holes 68 and 70, respectively on flanges 27 and 28. In addition, flange 26 contains a cold water inlet fitting 72 leading to a cold water pipe 74. The inlet pipe 22 has a drain line 76. A hot water outlet fitting 78 attaches to a hot water outlet 24 leading away from water heater 10. A lower operating thermostat 82 is usually located between the cold water fitting 72 and the hot water outlet fitting 78. Above the thermostat 82 is an upper operating thermostat 84 and a high limit thermostat 86. Lastly, a temperature and pressure relief valve fitting 88 also passes through flange 26. These fittings in flange 26 provide a means for communicating with the combustion chamber without having separate piping employed in the water heater 10 passing through the vessel 14 or its liner 29.

As shown in FIG. 1, the liner 29 for the inner surface 90 of the vessel 14 traps foam insulation 92 between the liner and surface 90. This insulation is preferably injected between liner 29 and surface 90 through a foam injection fitting 94 on the vessel 14. Expansion liner ports 96 are located in the sides of vessel 14. Alternatively, a solid foam insulation can be inserted between the vessel wall 90 and the liner 29. The liner 29 is preferably made from a solid polypropylene or other suitable rigid plastic material. Alternatively, the liner can be a high strength flexible plastic sheet. FIG. 2 shows the insertion of the liner 29 into vessel 14.

Figure 4:
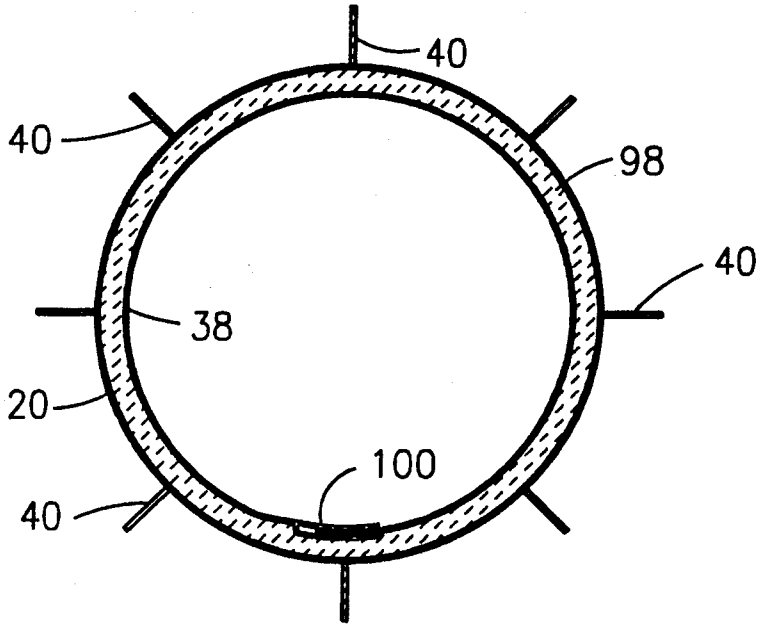
FIG. 4 is an end view of the combustion chamber inner shell showing the refractory lining and the stainless steel insert.
Figure 3:
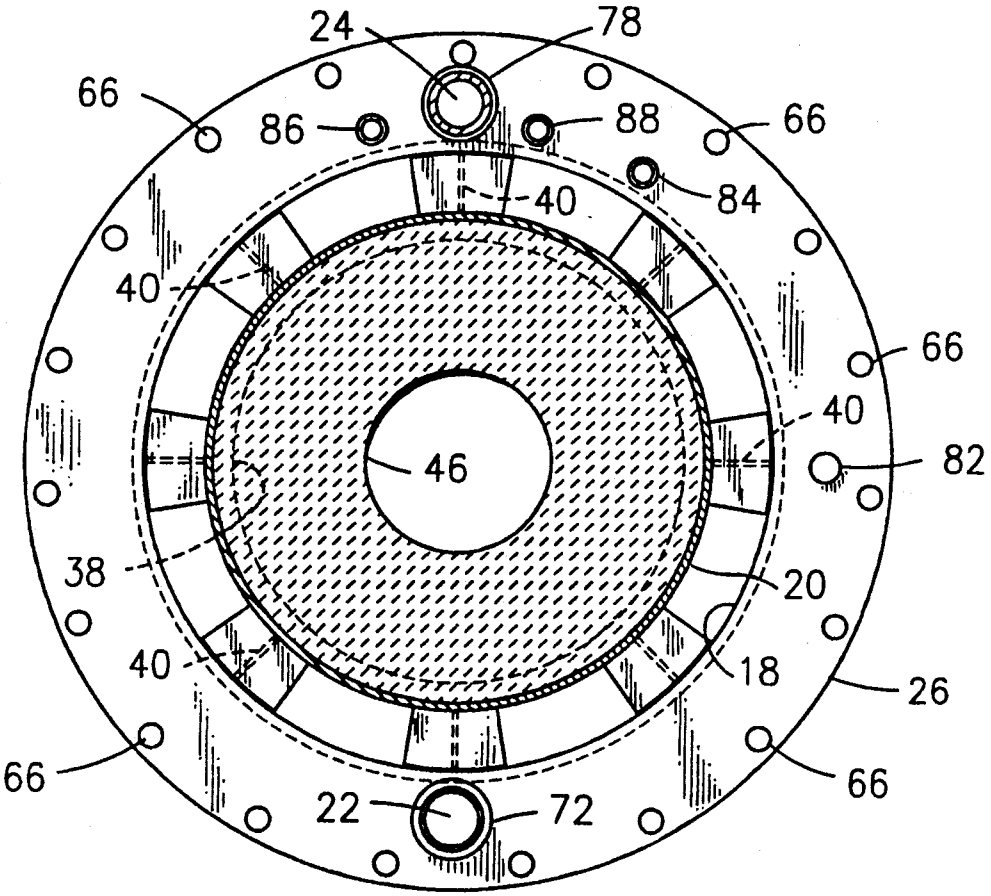
FIG. 3 is an end view of the first mounting flange integral with the outer shell and showing the relative positions of the various components.

As shown in FIG. 4, the inner surface of inner shell 20 has a layer of stainless steel 38 and a refractory blanket 98 provides protection for the outer shell 18. In addition, a lap joint 100 in the stainless steel 38 liner of inner shell 20 allows unrestricted expansion and contraction of the stainless steel 38.

It can be seen from the above description of the invention that the number of components is reduced in comparison to the known water heaters discussed above. Consequently, the production costs are decreased as are the number of potential component failures. Furthermore, the elimination of heat exchanger tubes passing through the liner or tank eliminates a very likely source of failure in the heating unit.

Having thus described the invention, what is claimed and desired to be secured by Letters Patent is:

1. In a potable hot water storage vessel apparatus containing a combustion chamber, a removable liner for an inner surface of the storage vessel and an outer shell around the combustion chamber, the improvement comprising a first flange integral with the outer shell around the combustion chamber, a second flange integral with a removable plastic storage vessel liner, a third flange integral with the storage vessel, the first flange containing openings for a water inlet and outlet fixture, the first, second and third flanges being firmly secured together while the storage vessel is operational, but being capable of rapid disassembly, a heat generating means including the combustion chamber installed within an opening in the first flange and sealed to the first flange, and the apparatus being devoid of internal piping passing through the storage vessel or liner.

2. The improved potable hot water storage vessel according to claim 1 wherein the first, second and third flange have multiple axially aligned bores for receipt of bolts to secure the flanges together.

3. The improved potable hot water storage vessel according to claim 1 wherein injectable foam insulation is located between the liner and storage vessel.

4. The improved potable hot water storage vessel according to claim 1 wherein an outer wall of the combustion chamber contains multiple longitudinally extending fins.

5. The improved potable hot water storage vessel according to claim 4 wherein baffles are positioned between the fins.

6. The improved potable hot water storage vessel according to claim 4 wherein a front end of the combustion chamber contains a back pressure assembly mounted around an outer circumference.

7. The improved potable hot water storage vessel according to claim 1 wherein a foam insert is located intermediate the liner and storage vessel.

8. The improved potable hot water storage vessel according to claim 1 wherein the first flange contains axial openings for a thermostat and pressure relief valve.

9. The improved potable hot water storage vessel according to claim 1 wherein the plastic storage vessel liner is a rigid polymer.

10. The improved potable hot water storage vessel according to claim 9 wherein the plastic storage vessel liner is a rigid polypropylene.

11. The improved potable hot storage vessel according to claim 1 wherein the plastic storage vessel liner is a flexible polymer.

12. A potable hot water storage vessel apparatus containing a combustion chamber comprising in addition, a removable rigid plastic liner for an inner surface of the storage vessel, a foam insulation intermediate the rigid liner and the storage vessel, an outer shell around the combustion chamber, a first flange integral with the outer shell around the combustion chamber, a second flange integral with the removable rigid plastic liner, a third flange integral with the storage vessel, the first flange containing openings for a water inlet and outlet fixture, a thermostat and pressure relief valve, the first, second and third flanges secured together by bolts while the storage vessel is operational, but being capable of rapid disassembly, a heat generating means including the combustion chamber installed within an opening in the first flange and sealed to the first flange, and the apparatus is devoid of internal piping passing through the storage vessel or liner.

* * * * *